US009196952B2

(12) United States Patent
Tran et al.

(10) Patent No.: US 9,196,952 B2
(45) Date of Patent: Nov. 24, 2015

(54) MULTIPURPOSE ANTENNA

(71) Applicant: QUALCOMM Incorporated, San Diego, CA (US)

(72) Inventors: Allen M. Tran, San Diego, CA (US); Jatupum Jenwatanavet, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 253 days.

(21) Appl. No.: 13/831,714

(22) Filed: Mar. 15, 2013

(65) Prior Publication Data

US 2014/0266920 A1 Sep. 18, 2014

(51) Int. Cl.

| | |
|---|---|
| ***H01Q 1/24*** | (2006.01) |
| ***H01Q 7/00*** | (2006.01) |
| ***H01Q 13/10*** | (2006.01) |
| *H01Q 1/27* | (2006.01) |
| *H01Q 5/357* | (2015.01) |

(52) U.S. Cl.

CPC ..... *H01Q 1/243* (2013.01); *H01Q 7/00* (2013.01); *H01Q 13/10* (2013.01); *H01Q 1/273* (2013.01); *H01Q 5/357* (2015.01)

(58) Field of Classification Search

CPC ..... H01Q 1/273; H01Q 1/243; H01Q 1/242; H01Q 1/241; H01Q 13/10; H01Q 13/18

USPC ..... 343/718, 702

See application file for complete search history.

(56) References Cited

U.S. PATENT DOCUMENTS

| | | | |
|---|---|---|---|
| 5,642,120 | A | 6/1997 | Fujisawa |
| 5,768,217 | A | 6/1998 | Sonoda et al. |
| 6,278,873 | B1 | 8/2001 | Itakura et al. |
| 7,271,774 | B2 | 9/2007 | Puuri |
| 8,169,374 | B2 | 5/2012 | Hill et al. |

(Continued)

FOREIGN PATENT DOCUMENTS

| | | | |
|---|---|---|---|
| EP | 1450437 | A1 | 8/2004 |
| EP | 2290742 | A1 | 3/2011 |

(Continued)

OTHER PUBLICATIONS

International Search Report and Written Opinion—PCT/US2014/025997—ISA/EPO—Jul. 17, 2014.

*Primary Examiner* — Hoang V Nguyen

(74) *Attorney, Agent, or Firm* — The Marbury Law Group, PLLC

(57) ABSTRACT

A multiband antenna for a wireless device includes a housing base portion, housing antenna portion and a feed contact. The housing base portion configured to receive radio circuitry thereon and include a first peripheral edge and a first conductive material. The housing antenna portion spaced away from and substantially opposed to the housing base portion, including a second peripheral edge and a second conductive material. The housing base and antenna portions together forming an outermost housing of the mobile wireless device, enclosing the radio circuitry there between. The first and second peripheral edges forming opposed lengthwise edges of a slot having a width formed by a distance between the first and second peripheral edges. The feed contact coupling the housing base portion, the housing antenna portion and the radio circuitry for providing at least one driving frequency to at least the housing antenna portion from the radio circuitry.

58 Claims, 12 Drawing Sheets

(56) References Cited

U.S. PATENT DOCUMENTS

| | | | | |
|---|---|---|---|---|
| 2007/0091004 | A1* | 4/2007 | Puuri | 343/718 |
| 2011/0234461 | A1* | 9/2011 | Grange et al. | 343/702 |
| 2012/0206302 | A1* | 8/2012 | Ramachandran et al. | 343/702 |
| 2013/0057437 | A1 | 3/2013 | Chiu et al. | |
| 2013/0127673 | A1* | 5/2013 | Chang et al. | 343/702 |
| 2013/0194138 | A1* | 8/2013 | Hammond | 343/702 |

FOREIGN PATENT DOCUMENTS

| | | | |
|---|---|---|---|
| EP | 2562870 | A1 | 2/2013 |
| GB | 12217112 | A | 10/1989 |
| GB | 2431522 | A | 4/2007 |

* cited by examiner

MULTIPURPOSE ANTENNA

FIELD

The present application relates to a multipurpose antenna, and more particularly to an antenna system having multiple antennas that efficiently utilize space in a mobile wireless device.

BACKGROUND

Mobile computing devices have seen explosive growth over the past few years. With growing computational power and memory capacity, personal computing devices, have become essential tools of modem life, providing telephone and text communications, navigation, photo and video functionality in a package that fits in one's pocket. Currently, while processors have become very smaller, they have also become even more powerful. Many have attempted to create a smaller sized mobile phone in a watch casing or a similar small footprint for example about 30 to 50 mm or less. However, these attempts have been generally unsuccessful.

One of the reasons for the lack of success is the inability to design an efficient antenna capable of transmitting and receiving radio signals over all of the desired networks and frequency bandwidths in aesthetically pleasing watch housing. Conventional antennas designed for mobile devices, such as a mobile phone in a watch casing, are extremely sensitive to any metallic parts that are in close proximity to the antenna. Particularly since the most common devices such as mobile phones, global positioning system (GPS) units, and wireless local area network (WLAN) devices are intentionally designed for radiation only. Thus, casings formed with metal often interfere with such conventional antennas. Also, most conventional watch designs include a metal bezel or ring which may be used to frame the components contained therein or as a decorative feature. However, such metal bezels/rings formed on the top of watches interfere with antennas housed within the watch attempting to radiate a signal away from the device. Additionally, using conventional design techniques any metal structure can not be a complete loop structure without a break in that loop in order to function as an antenna operating at the desirable frequency. Therefore, conventional wearable wireless devices, such as watch phones, are forced to be designed without metal bezels to avoid these problems. Regardless, such design constraints are generally unwelcome to designers who want to take advantage of the popularity of metal casings.

SUMMARY

The various aspects and embodiments described herein include an antenna design that may be formed as part of a metal frame or housing of a mobile wireless device. The antenna may be a multiband antenna of a mobile wireless device and may include a housing base portion, a housing antenna portion and a feed contact. The housing base portion may be configured to receive radio circuitry thereon. Also, the housing base portion may include a first peripheral edge and a first conductive material. The housing antenna portion may be spaced away from and substantially opposed to the housing base portion. Also, the housing antenna portion may include a second peripheral edge and a second conductive material. The housing base portion and the housing antenna portion may together form an outermost housing of the mobile wireless device for enclosing a substantial portion of the radio circuitry there between. Additionally, the first peripheral edge and the second peripheral edge may form opposed lengthwise edges of a slot. The slot may have a width formed by a distance between the first peripheral edge and the second peripheral edge. The feed contact may be coupled to the housing base portion, the housing antenna portion and the radio circuitry for providing at least one driving frequency to at least the housing antenna portion from the radio circuitry.

The multiband antenna described herein may thus be formed as part of relatively small wearable items, such as a wrist-worn wireless device including a watch, tracking device or general communication device including wireless communication elements. Also, the multiband antenna of the various embodiments may be configured to serve as a structural and/or decorative metal ring, such as a watch bezel replacing a structure that might interfere or couple with a conventional antenna.

Further embodiments may include a method of making the multiband antenna discussed above.

BRIEF DESCRIPTION OF THE DRAWINGS

The accompanying drawings are presented to aid in the description of embodiments of the disclosure and are provided solely for illustration of the embodiments and not limitation thereof.

DETAILED DESCRIPTION

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the disclosure or the claims. Alternate embodiments may be devised without departing from the scope of the disclosure. Additionally, well-known elements of the disclosure will not be described in detail or will be omitted so as not to obscure the relevant details of the disclosure.

The word "exemplary" is used herein to mean "serving as an example, instance, or illustration." Any implementation described herein as "exemplary" is not necessarily to be construed as preferred or advantageous over other implementations. Additionally, use of the words, "first," "second," "third," "primary," "secondary," "tertiary" or similar verbiage is intended herein for clarity purposes to distinguish various described elements and is not intended to limit the invention to a particular order or hierarchy of elements.

The various embodiments provide a multiband antenna design that may be formed as part of a metal housing of a mobile communication device in which circuitry and additional components are contained and/or mounted. Thus, aspects of the disclosed technologies may be used to form all or part of the bezel or other housing elements of a wrist-worn device with wireless communication elements. As used herein, the term "housing" refers to a rigid or semi-rigid casing that surrounds, encloses or substantially surrounds/encloses and protects elements contained therein. In the various embodiments portions of the multiband antenna serve as an outermost housing for a wireless communication device.

Figure 1:
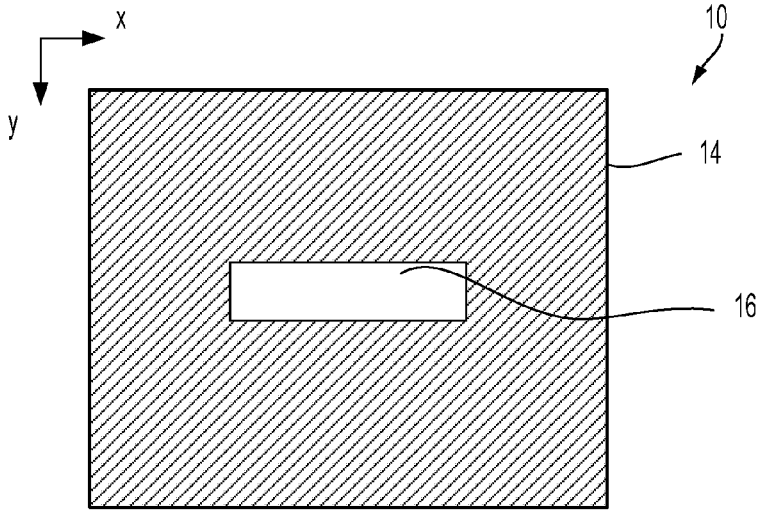
(PRIOR ART) FIG. 1
FIG. 1 is a plan view of prior art slot antenna.

The multiband antenna of the current disclosed technologies are based upon traditional slot antenna designs, which form an antenna from a metal ring configuration in an electrically conductive plate. FIG. 1 shows a traditional slot antenna 10 formed from a plate 14 of conductive material, such as metal, having a slot 16 formed therein. When the plate is excited by a driving frequency, the slot 16 radiates electromagnetic waves in a manner similar to a dipole. The shape and size of the slot, as well as the driving frequency, determine the radiation distribution pattern. A traditional slot antenna is typically formed as a single planar plate. For sake of reference among the figures, a 2-dimensional reference may be shown with x-y axis, y-z axis or x-z axis labeled, as well as a 3-dimensional reference may be shown with an x-y-z axis labeled. Thus, the slot antenna 10 is illustrated in FIG. 1 as disposed in an x-y plane, although the orientation of the antenna is arbitrary.

A multiband antenna in accordance with the embodiments disclosed herein can be made by various methods and forms. However, for illustrative purposes planar antenna base plates 11, 90 are shown in FIGS. 2-5 in order to explain the relocation and/or reconfiguration of elements from the traditional planar slot antenna design to that of the disclosed antennas. Nonetheless, neither the base portion nor the antenna portion need to be planar.

Figure 2:
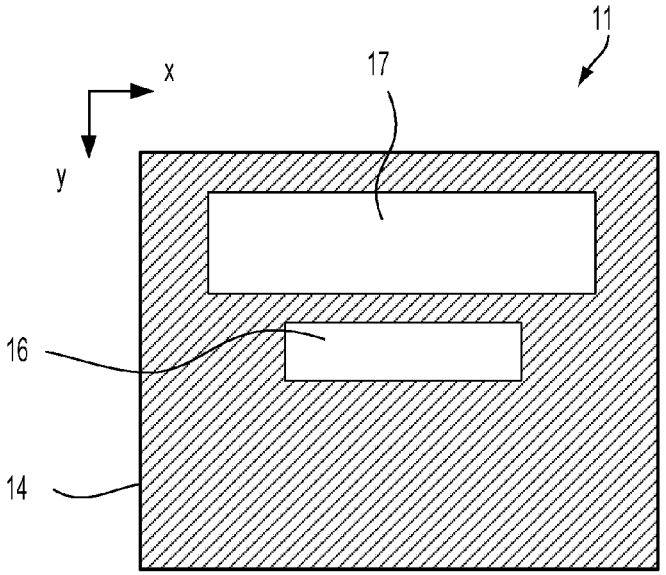
FIG. 2 is a plan view of a modified slot antenna in accordance with an embodiment.

FIG. 2 shows a trimmed slot antenna 11 formed from a plate 14 having a slot 16 formed therein. However, some material has be "trimmed" away or removed from the plate to form an aperture 17. As with the slot antenna 10 shown in FIG. 1, when the plate 14 of slot antenna 11 is excited by a driving frequency, the slot 16 radiates electromagnetic waves. The dimensions of the aperture 17 may be selected to form a bezel or ring of a watch housing or part thereof. Thus, by forming a slot antenna that includes an aperture 17, the antenna itself may be used as a frame or bezel of a mobile communication device, such as a watch that includes a ring-shaped bezel. In this way, a watch's bezel may serve as both an antenna and a structural element (as well as asthetic). In addition, an antenna having this type of loop structure without any breaks in the loop (i.e., a closed loop), and having a ground connection to the RF ground of circuit board, may also be used as an electrostatic discharge (ESD) protection for the circuitry of an electronic device.

Figure 3:
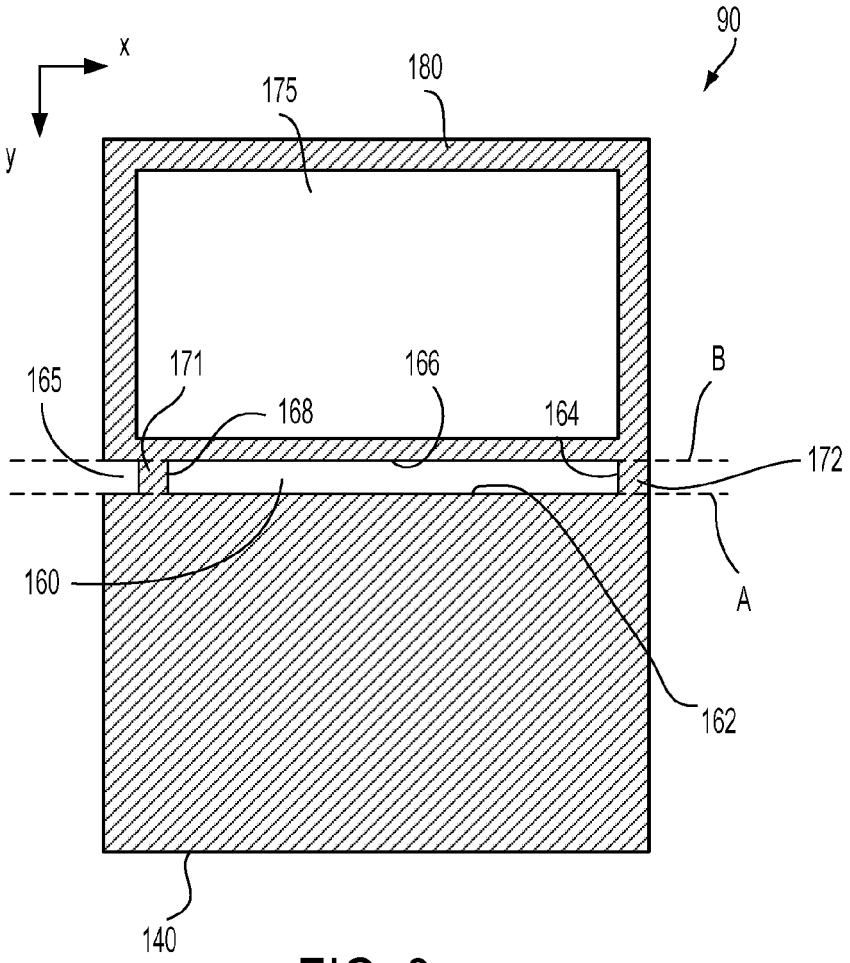
FIG. 3 is a plan view of a further modified slot antenna in accordance with an embodiment.

FIG. 3 shows a further modified slot antenna 90 with a slot 160 and an aperture 175. This slot antenna 90 is similarly illustrated as having a flat (i.e., planar) configuration similar to traditional slot antennas, but can be further modified to enable it to serve as a housing for other components while remaining compact, such as for a wristwatch with wireless communication elements.

Further modifications to the antenna base plate 90 of FIG. 3 provide an example of how to arrive at a multiband antenna in accordance with aspects of the disclosed technologies. This embodiment antenna base plate 90 includes a slot 160, a base portion 140 (shown below the slot in FIG. 3), and an antenna portion 180 (shown above the slot in FIG. 3 and which includes aperture 175). The slot 160 is an aperture extending through a full thickness of the antenna base plate 90. The slot 160 has two elongate edges 162, 166, which may extend along the x-axis and be formed respectively by one edge 162 of the base portion 140 and one edge 166 of the antenna portion 180. The shorter slot edges 164, 168 may extend along the y-axis and be formed by inner edges of two portions 171, 172 that serve as ground contacts between the antenna and RF ground of circuit board. Again, references to the x and y axes are for illustration purposes and are not intended to suggest particular coordinate reference frame requirements.

The base portion 140 and the antenna portion 180 remain connected and functionally coupled by the two ground contacts 171, 172. In this way, the two ground contacts 171, 172 together with the base portion 140 and the antenna portion 180 form the perimeter of the slot 160. As described further below, the size of the slot 160 can be varied as desired for preferred operating parameters, such as frequency range of the antenna. In this way, the distance between the ground contacts 171 and 172 could be adjusted to be closer or further apart and the ground contacts 171, 172 may be made narrower or wider. In addition to the two ground contacts 171, 172 shown in the figure, separate ground contacts may be formed to couple the base portion 140 and the antenna portion 180. Further, the ground contacts 171, 172 may be formed to have an outer edge coincident with the outer edges of the base portion 140 and/or the antenna portion 180, as exemplified by ground contact 172. Alternatively, the ground contacts 171, 172 may be positioned with an offset 165 from the outer edges of the base portion 140 and/or the antenna portion 180, as exemplified by ground contact 171. The offset 165 of one or more of the ground contacts 171, 172, or lack thereof, may be included as desired for preferred operating parameters of the antenna.

The various embodiments improve upon traditional slot antenna designs, such as shown in FIG. 1, by providing a trimmed portion in the form of an aperture 175 on the antenna portion 180, which also forms a closed loop. The aperture 175 is also an aperture through the base plate 90, like the slot 160. In the illustrative embodiments, the aperture 175 has a significantly larger area than that of the slot 160. However, as noted with regard to the slot 160 described above, the size and proportions of the aperture 175 may be formed as desired for preferred operating parameters of the antenna.

Figure 4:
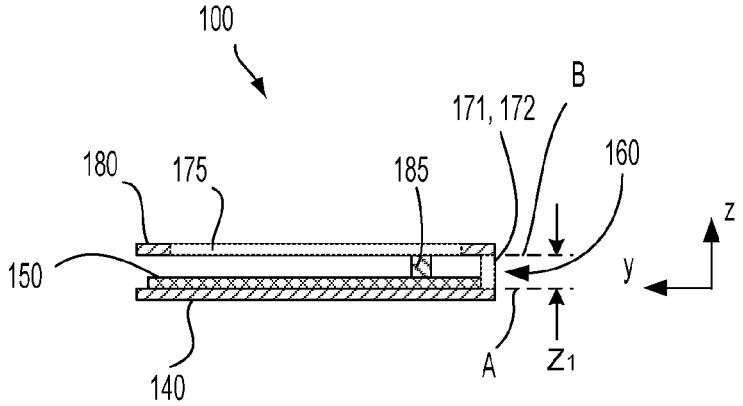
FIG. 4 is a side cross-sectional view of a multiband slot antenna in accordance with an embodiment.
Figure 5:
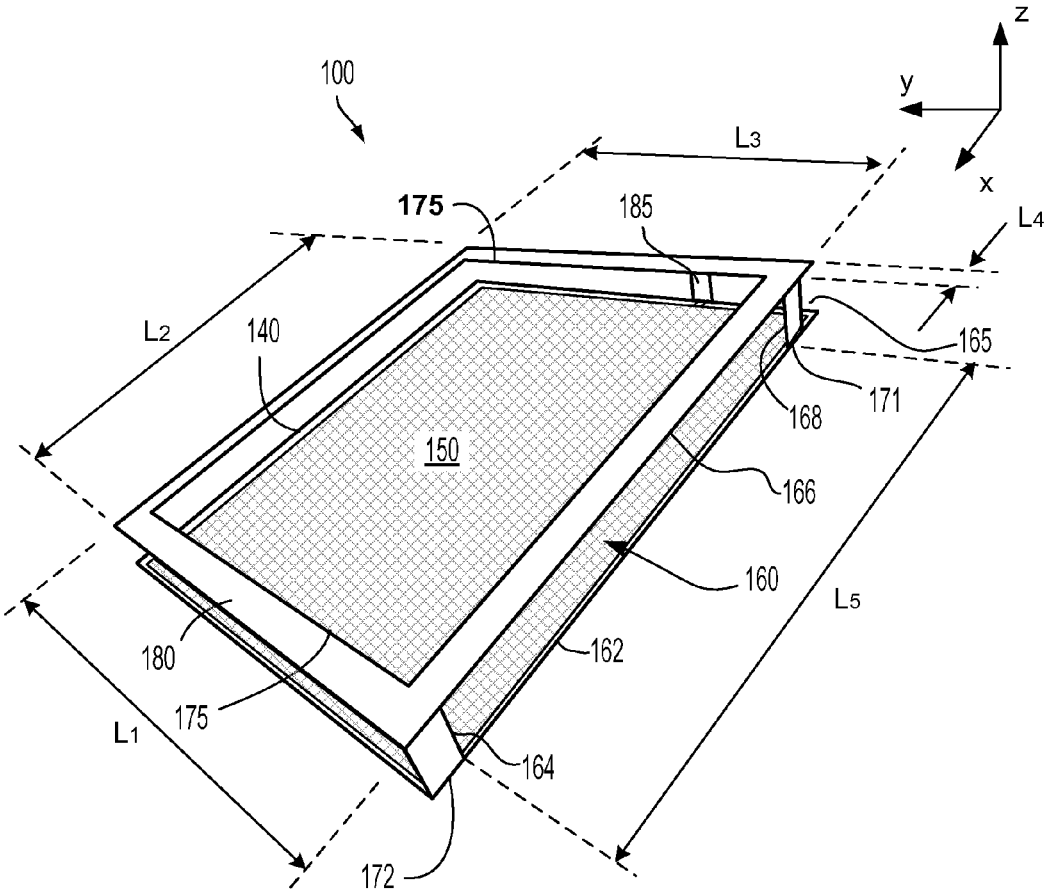
FIG. 5 is a perspective view of the multiband antenna of FIG. 4.

The disclosed multiband antenna further improves upon traditional slot antenna designs by providing a 3-dimensional component to the antenna, which is formed by bending the slot along line A and line B that are coincide with opposed elongate edges of the slot 160 spaced apart from one another and extending along the x-axis. Thus, as shown in FIG. 4, a 3-dimensional component can be provided by folding the ground contacts 171, 172 and antenna portion 180 ninety degrees relative to the base portion 140 along line A. This leaves the base portion in a first x-y plane, but has the ground contacts 171, 172 and antenna portion 180 extending into a third dimension (the z-axis). The antenna portion 180 is folded ninety degrees relative to the ground contacts 171, 172 a second time along line B toward the base portion 140. This leaves the ground contacts 171, 172 in an x-z plane with the antenna portion 180 in a second x-y plane spaced away (offset) from the first x-y plane. As shown in FIG. 4 and FIG. 5, effectively folding the outer portions 140, 180 in this manner situates the ground portion 140 and the antenna portion 180 parallel to one another, with both being perpendicular to the plane of the ground contacts 171, 172 as well as the slot 160. These folds at lines A and B thus transform the planar modified slot antenna 90 into a 3-dimensional slot antenna 100 that has structural and configurational benefits while retaining the performance of a slot antenna.

The foregoing description of folding the antenna portions are intended to illustrate how the embodiment configurations result in a multipurpose antenna with radio-frequency radiation performance characteristics of a slot antenna. However, the multiband antenna embodiments need not be formed from a single unitary base plate, such as plate 90 described above. Rather, the base portion 140 and the antenna portion 180 may be formed from separate and discrete elements that are electrically connected during assembly as illustrated in the figures. Also, these elements once configured 3-dimensionally as described above, may together form a unitary housing for the very radio circuitry using the multiband antenna. For this reason, the base portion and antenna portion are additionally referred to herein as the housing base portion 140 and the housing antenna portion 180, respectively. Similarly, the ground contacts 171, 172 may be separate elements electrically coupled to the housing base portion 140 and the housing antenna portion 180.

A multiband antenna in accordance with the various embodiments is essentially formed by two housing portions that are spaced away from one another and substantially opposed to one another. In this way, extensive surface areas of each housing portion are facing toward each other. The housing base portion 140 is shown extending in a first plane. The housing base portion 140 may be formed of a conductive material serving as a support structure for a radio circuitry, such as a printed circuit board 150 and/or may have circuitry directly mounted or printed thereon. Alternatively, radio circuitry elements may be integrally formed directly onto the housing base portion 140, which thus still supports the electrical components of the circuitry. The radio circuitry elements may include a processor coupled to memory and a power source, such as a battery, as well as other conventional elements. While the housing base portion 140, ground contacts 171, 172 and housing antenna portion 180 each have their own respective thickness, a peripheral edge of the housing base portion 140, a peripheral edge of the housing antenna portion 180 and inner edges of the ground contacts 171, 172 together surround and define the slot 160. The housing base portion 140 and the housing antenna portion 180 may together form an outermost housing of a mobile wireless device for enclosing a substantial portion of its radio circuitry there between. The peripheral edge of the housing base portion and the peripheral edge of the housing antenna portion may form opposed lengthwise edges of the slot. Also, the slot may have a width formed by a distance between those peripheral edges. In this illustrated example where the housing base portion 140, and the housing antenna portion 180 are generally planar and parallel to one another, the slot 160 is said to extend or be disposed in a common x-z plane with the ground contacts 171, 172. The slot 160 may alternatively be formed in the common y-z plane or may be disposed in both the x-z and y-z planes, such that the plane of the slot 160 is substantially perpendicular to the x-y plane of the housing base portion. However, the slot 160 need not be perpendicular to either the housing base portion 140 nor the housing antenna portion 180, as described further below.

Additionally, the disclosed multiband antenna includes a feed 185 (also referred to as a lead or feed contact), which is coupled to an thus connects the housing antenna portion 180 and the housing base portion 140. The feed 185 supplies the driving frequency to the antenna at the housing antenna portion 180 and is thus operatively coupled to the radio circuitry including transmitter(s), receiver(s) and the printed circuit board 150. Thus, electrical energy may be injected into the housing antenna portion 180 from the feed contact 185. At these locations, the current density is at a maximum value, while the electrical field is minimized. The housing base portion 140 thus serves as a ground plane for the overall multiband antenna through its connection to the housing antenna portion 180 by way of the ground contacts 171, 172.

Conductive materials, such as those used for the housing base portion 140, the housing antenna portion 180, the ground contacts 171, 172 and the feed 185 may be formed from gold, copper or other suitable conducting material. Also, these elements need not be made from the same material. Additionally, the materials used for these elements may be flexible, rigid or some combination thereof. Also, the elements may be formed by rolling, extrusion, etching, cutting, bending, stamping, melting, mold injection or other known techniques. An example of alternative conductive materials include Pyralux® copper-clad laminated composites, also referred to as laminate flex. Pyralux® copper-clad laminated composites can be made of DuPont® Kapton® polyimide film with copper foil on one side bonded to the polyimide film with acrylic adhesive. In another implementation, the multiband antenna can be made using a carrier substrate supporting conductive ink. Such conductive ink may be applied by spraying onto a carrier material as desired, for example to form appropriate circuitry or control the size, shape, configuration or other functions of the antenna.

The multiband antenna structure disclosed herein exhibits a half wavelength based on the total length between the two antenna ground contacts 171, 172 along the length of the conductive housing antenna portion 180 that includes the feed contact 185 therebetween. For the embodiment shown in FIG. 5, that total length includes the sum of the length of three sides of the housing antenna portion 180, plus the offset space of the one ground contact 171 (Total Length=$L_1+L_2+L_3+L_4$). Thus, the desired operating frequency for the antenna 100 may be varied by adjusting this length. Additionally, a second frequency band is available corresponding to the length of the conductive housing antenna portion 180 directly between the two ground contacts 171, 172, along the length not including the feed contact 185 (Total Length=$L_5$). Further, third and fourth frequency bands are available corresponding to the total circumferential length from one side of each ground contact 171, 172 to the respective opposite side of the same ground contact around the housing antenna portion the long way. Examples of this are further described with regard to FIG. 6C and FIG. 6D below. These third and fourth frequency bands may vary depending upon how wide each of those ground contacts is relative to the other, since the width of the ground contacts does not substantially factor into the total circumferential length. Also, by manipulating the placement of the feed contact 185 along the path between ground contacts 171, 172, the total operating frequency range of the embodiment antenna may be varied.

Figure 6A:
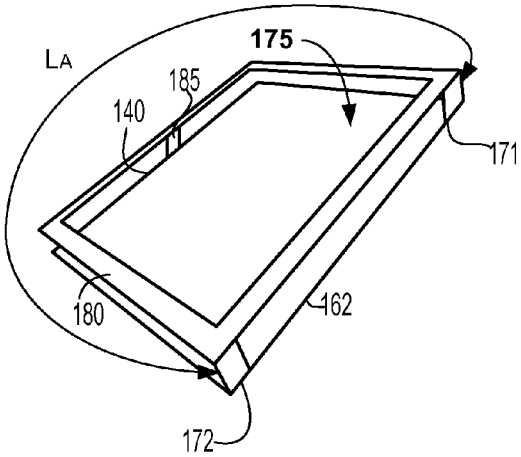
FIGS. 6A-6D are perspective views of further frequency bands available from a multiband slot antenna in accordance with additional embodiments.
Figure 6B:
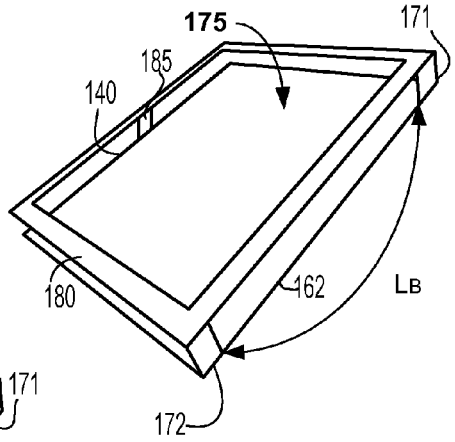
Figure 6C:
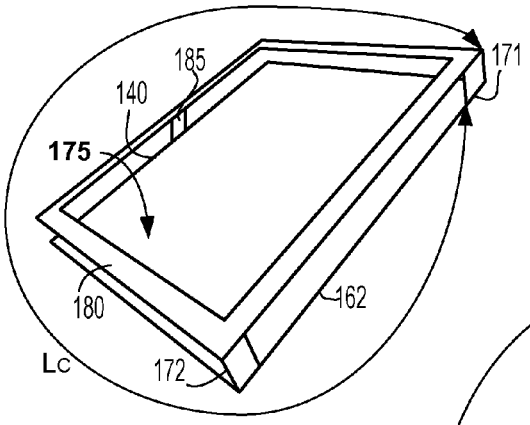
Figure 6D:
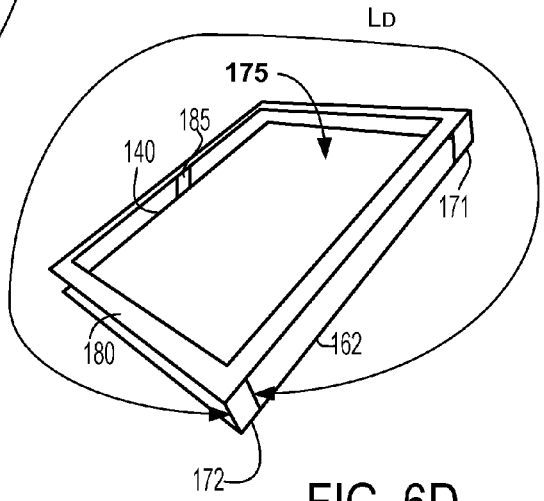

FIGS. 6A-6D illustrate further characteristics of a multipurpose antenna in accordance with the various embodiments. FIG. 6A shows a first peripheral length $L_A$, which extends along the peripheral length of the housing antenna portion that includes the feed contact 185 therebetween, that corresponds to a first frequency band ($\lambda_A/2$). FIG. 6B shows a second peripheral length $L_B$ that corresponds to a second frequency band ($\lambda_B/2$). That second peripheral length $L_B$ extends between the two ground contacts 171, 172 along the peripheral length of the housing antenna portion that does not include the feed contact 185 therebetween. FIG. $\mathbf{6}_C$ shows a third peripheral length $L_C$ that corresponds to a third frequency band ($\lambda_C/2$). That third peripheral length $L_C$ extends from one side of a first ground contact 171 around periphery of the housing antenna portion the long way to the opposed second side of the same first ground contact 171. FIG. 6D shows a fourth peripheral length $L_D$ that corresponds to a fourth frequency band ($\lambda_D/2$). The fourth peripheral length $L_D$ is similar to that of $L_C$, but does not include the width of the second ground contact 172 rather than not including the width of the first ground contact 171 as in the case of the third frequency band.

Figure 7A:
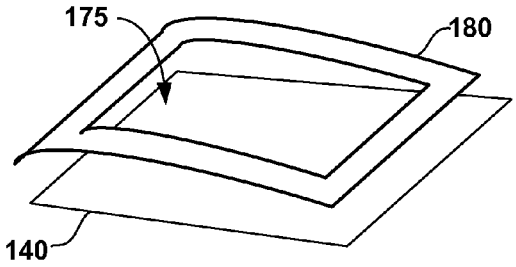
FIG. 7A-7B are perspective views of alternative housing antenna portions in accordance with additional embodiments.
Figure 7B:
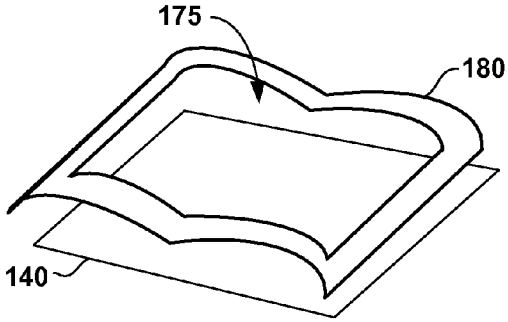

FIG. 7A and FIG. 7B illustrate how the housing antenna portion 180 may be curved, bent and/or irregularly shaped. Also, while the various elements, such as the housing antenna portion 180 and the housing base portion 140, are shown as having a constant and infinitely thin thickness, it should be understood that these elements have a real thickness, which may vary along portions of these elements. Also, while the housing base portion is shown as being planar, it too may be curved, bent and/or irregularly shaped.

Figure 8A:
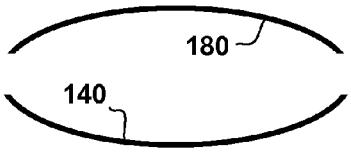
FIGS. 8A-8E are side elevation views of various alternative antenna shapes in accordance with various embodiments.
Figure 8B:
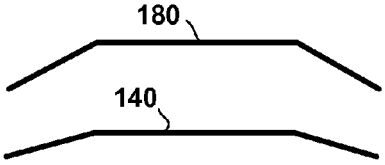
Figure 8C:
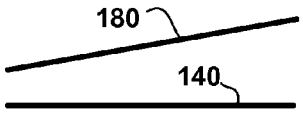
Figure 8D:
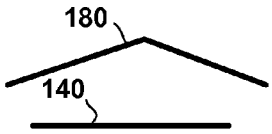
Figure 8E:
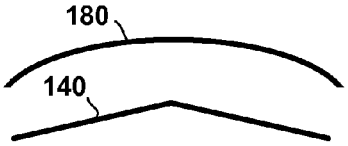

FIG. 8A through FIG. 8E illustrate side elevation views of simplified versions of the housing antenna portion 180 and the housing base portion 140. These further illustrations illustrate how the housing antenna portion and the housing base portion need not be parallel to one another. The housing antenna portion and the housing base portion may each have different shapes and sizes. FIG. 8A shows two concave housing portions 140, 180, curving away from one another at their centers. FIG. 8B shows two housing portions 140, 180 that are each bent forming a concave-like structure, but with flat sections. In the example illustrated in FIG. 8B the two housing portions 140, 180 are concave in the same direction. FIG. 8C shows planar examples, but illustrates how the two housing portions 140, 180 need not be parallel to one another. FIG. 8D shows the housing antenna portion 180 having a completely different shape from that of the housing base portion 140. Also, FIG. 8D further illustrates how the total area of the housing antenna portion 180 need not be equal to the total area of the housing base portion 140. In this way, the slot formed on the lateral sides (as shown in FIG. 8D) from the edges of the housing antenna portion 180 and the housing base portion 140 may extend at a biased angle (not perpendicular) to those portions.

Figure 9A:
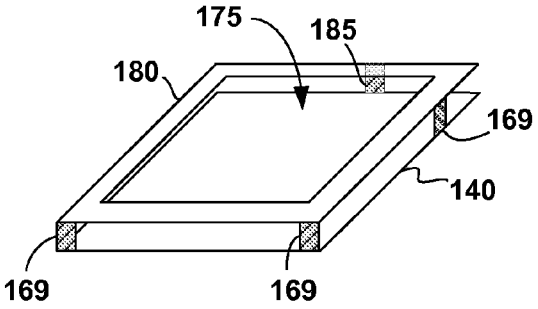
FIGS. 9A-9D are perspective views of further alternative embodiments of multiband antenna.
Figure 9B:
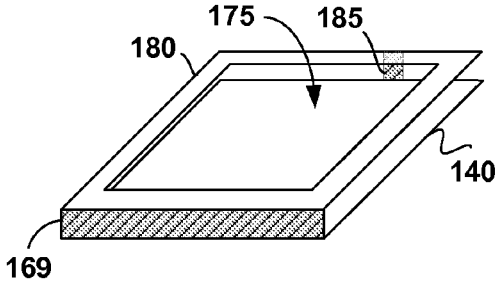
Figure 9C:
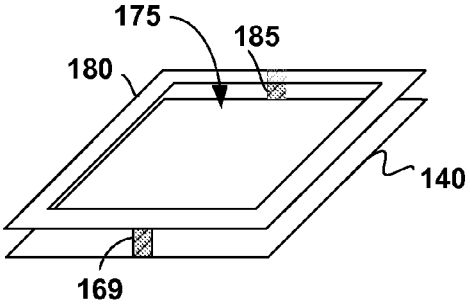
Figure 9D:
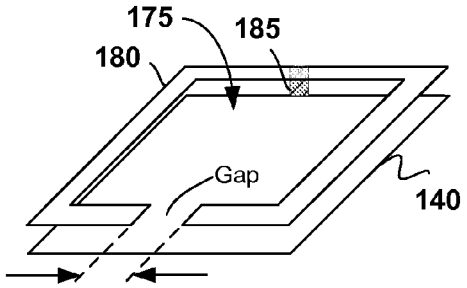

FIG. 9A through FIG. 9D illustrate further embodiments of the multiband antenna. FIG. 9A shows an embodiment with three spaced apart ground contacts 169 coupling the housing antenna portion 180 to the housing base portion 140. Also, FIG. 9A shows the feed contact 185 disposed on an opposite edge from that of two of the ground contacts 169. FIG. 9B illustrates how the ground contact 169 may be reduced to a single element. In this embodiment, only one ground contact is affixed to the housing antenna portion 180 and the housing base portion 140. FIG. 9C is similar to FIG. 9B in that only a single ground contact 169 is used, but the width of the ground contact 169 in FIG. 9C is substantially narrower. FIG. 9D illustrates a further embodiment that eliminates the ground contacts entirely and only includes a feed contact 185 coupling the housing antenna portion 180 and the housing base portion 140. The embodiment illustrated in FIG. 9D further includes a discontinuity in the form of a gap in the otherwise closed-loop housing antenna portion. The discontinuity extends across the housing antenna portion from the outer peripheral edge of the housing antenna portion to the aperture forming an open space in the central region of the housing antenna portion. That Gap acts like a ground contact, including defining the housing antenna portion peripheral length corresponding to a frequency band of the multipurpose antenna.

Figure 10:
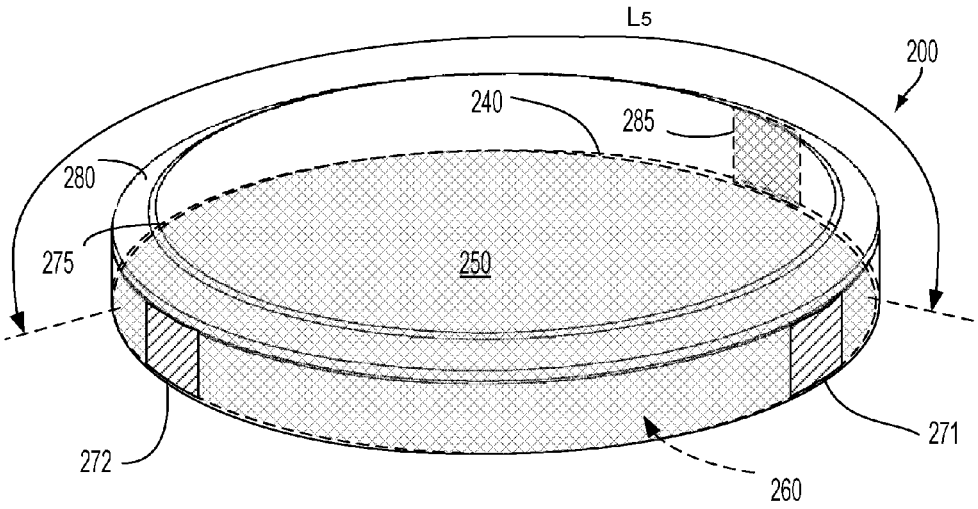
FIG. 10 is a perspective view of another multiband antenna in accordance with a further embodiment.

FIG. 10 shows an alternative multiband antenna 200 in which the overall structure may be round, elliptical or cylindrical resembling a watch housing, including the bezel. The antenna 200 in this embodiment includes a housing base portion 240 configured to receive radio circuitry 250 thereon. The housing base portion 240 in this embodiment includes a conductive material for acting as a ground plane of the antenna. The antenna 200 in this embodiment also includes a housing antenna portion 280, which is also formed of a conductive material (although not necessarily the same conductive material as the housing base portion 240). The housing antenna portion 280 in this embodiment is offset from the housing base portion 240. While the housing antenna portion 280 in this embodiment has a slight conical structure, it remains spaced away from the housing base portion 240. A lower edge of the housing antenna portion 280 in this embodiment is also spaced away from the housing base portion. While this illustration shows the housing base portion 240 and both the top and bottom edges of the housing antenna portion 280 to be disposed in three planes that are substantially parallel to one another, such a configuration is optional. The three planes in which those surfaces are disposed may lie in planes that are angled relative to one another. Also provided in this embodiment is a feed contact 285 coupling the housing base portion 240 and the housing antenna portion 280. Further, two ground contacts 271, 272 are provided in this embodiment, each further coupling the housing base portion 240 and the housing antenna portion 280. An inner edge of the two ground contacts 271, 272, together with an edge of the housing base portion 240 and an edge of the housing antenna portion 280 form a perimeter of a slot 260 in this embodiment. In this embodiment, the slot extends like an arched wall that is substantially perpendicular to the first and second planes. In this embodiment, the length between the two ground contacts 271, 272 along the portion of the housing antenna portion 280 having the feed contact disposed thereon is measured by one long arc having a total length $L_5$. A half wavelength of this multiband antenna 200 is based on that total length $L_5$.

Figure 11:
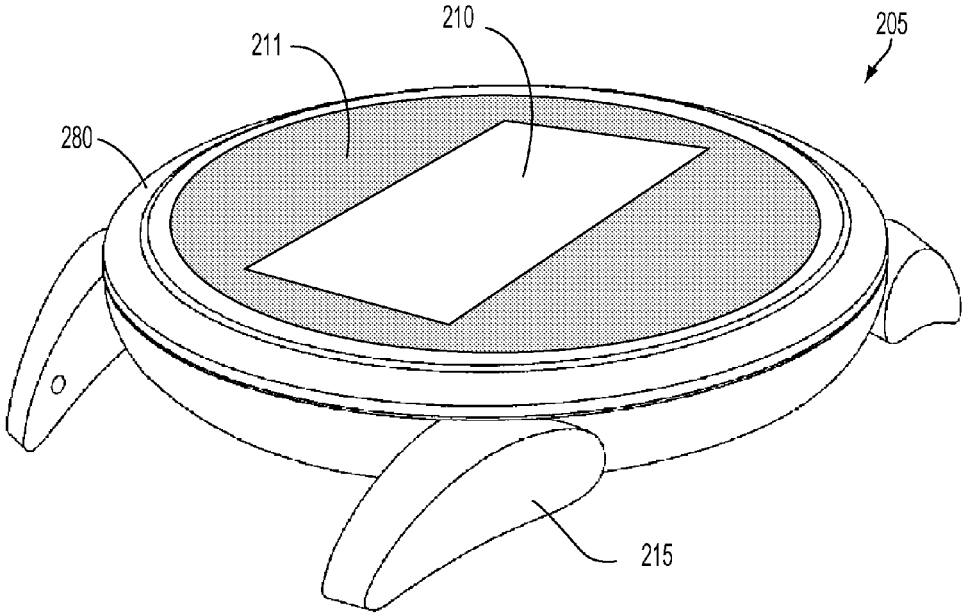
FIG. 11 is a perspective view of the multiband antenna of FIG. 10 incorporated into a watch.

FIG. 11 shows how the multiband antenna 200 embodiment of FIG. 6 can be incorporated into or used as the housing of a watch-size wireless communication device 205. In this embodiment watch face includes a liquid crystal display (LCD) 210 that may be operatively coupled to the radio circuitry underneath. The LCD 210 may include its own conductive material 211 on a peripheral portion thereof. This conductive material 211 may be coupled to the conductive materials of the housing portions and forms an extension thereof. Additionally, the device 205 may include watchband attachment elements 215, as are typical with contemporary watch designs.

Aspects of the present disclosure relate to a multiband antenna for a mobile device. The antenna may be attached to an object or attached via an intermediary to an object, for example a person or a pet. Examples of an intermediary are a pet collar, wrist band or waist band. The mobile device may incorporate into a wearable device, enabling the location of that person or pet to be monitored. For example, the mobile device may be worn by a child in an amusement park or public space, or an adult with dementia. The mobile device may be worn by a patient in a hospital or employees/staff members so their location can be monitored. The multiband antenna may be a three or more band antenna. The antenna may operate at a number of different frequencies, examples include the Cell band (824-894 MHz), GPS band (1565-1585 MHz), PCS band (1850-1990 MHz), or ISM band (902-928 MHz).

A multiband antenna in accordance with the various embodiments may receive modulated signals from a base station and provide the received signals to a demodulator within the mobile device or operatively coupled thereto. The demodulator may then process (e.g., conditions and digitizes) the received signals, obtain input samples and even perform orthogonal frequency-division multiplexing (OFDM) demodulation on the input samples. Also, a receiver data processor within the mobile device or operatively coupled thereto may processes frequency-domain received signals and provide decoded data to a controller/processor of the mobile device. The controller/processor may then generate various types of signaling for transmission via the multiband antenna. Additionally, a transceiver data processor within the mobile device or operatively coupled thereto may generate signaling, which can be processed by a modulator and transmitted and/or received via the multiband antenna to a base station. In addition, the controller/processor may direct the operation of various processing units within or operatively coupled to the mobile device.

One embodiment of a multiband antenna is sized and configured to operate in the operating frequency range of a global positioning system (GPS) network from 1565-1610 MHz, as well as alternative global navigation satellite system (GLONASS) with an operating frequency range from 1597-1606 MHz or a combination thereof, such as GNSS. These two separate frequency ranges are examples of how the embodiments may provide more than one driving frequency selected from separate (i.e., non-consecutive) ranges of driving frequencies. However, a multiband antenna in accordance with the aspects of the invention herein need not be limited to these frequency ranges. Variations within the scope of this disclosure can achieve additional and/or different frequency ranges.

Figure 12:
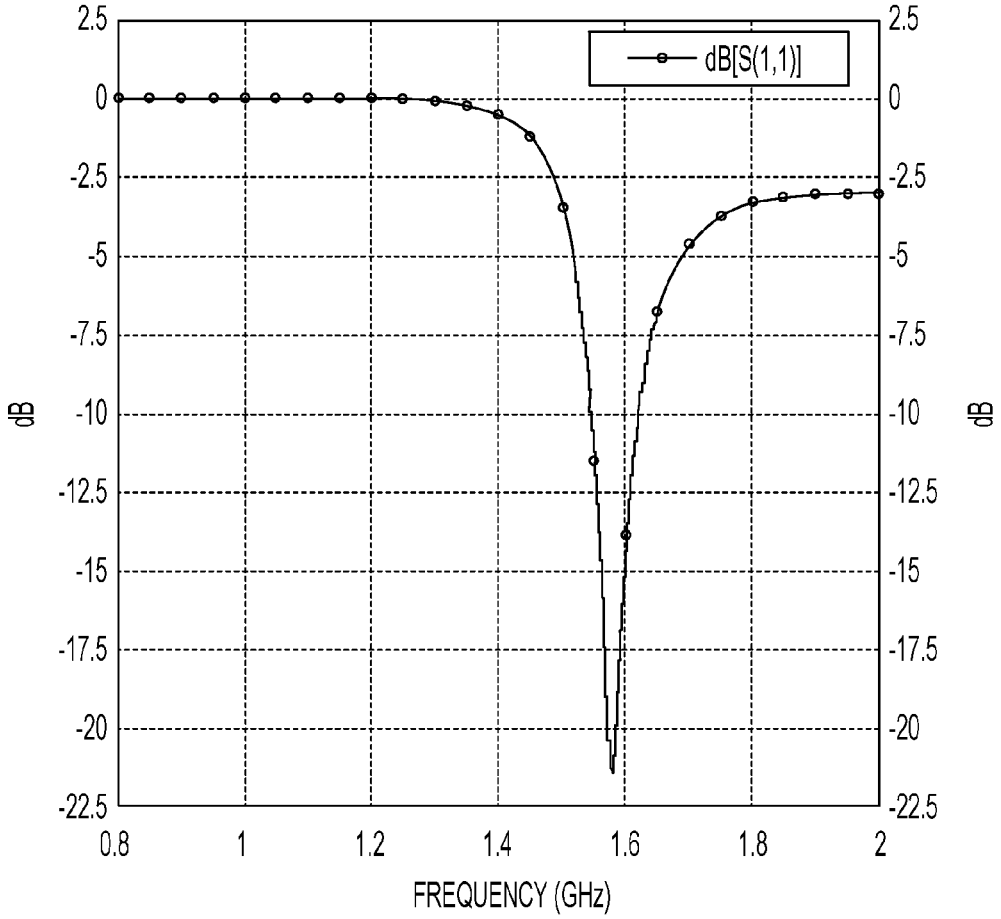
FIG. 12 is a graph of simulation results of the performance of a multiband slot antenna in accordance with an embodiment.

When designing an antenna one may consider an antenna's return loss. Return loss (S11) is a measure of how much energy is reflected by the antenna back toward the device in which the antenna is implemented. When a particular antenna design is implemented in a device and energy is provided to the antenna, one may measure the return loss to determine how efficiently the antenna design is radiating a signal away from the device containing the antenna (and toward a receiving device). The measure of return loss is viewed along a dB scale. FIG. 12 shows simulated return loss results exhibited by an embodiment antenna, reflecting return loss of less than −10 dB across the desired frequency band. Any return loss less than −5 dB across the desired operating band is considered to be a well designed antenna.

Figure 13:
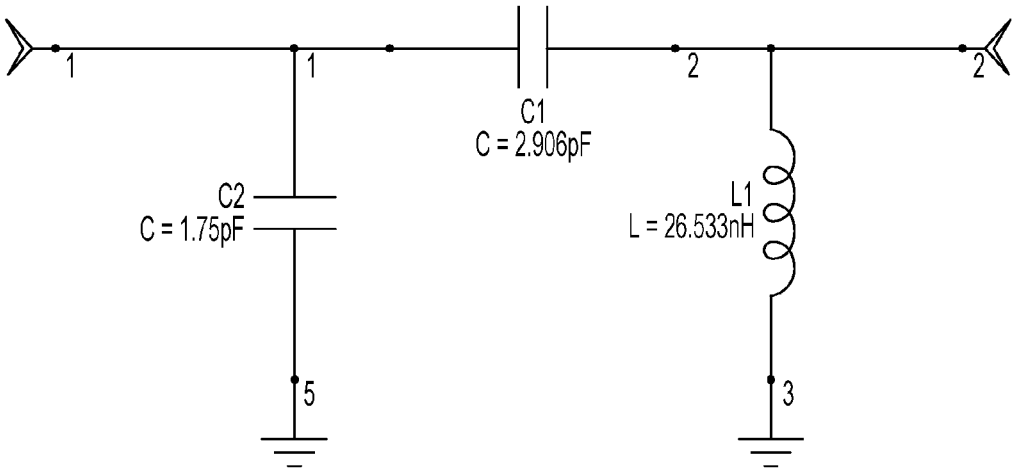
FIG. 13 is a circuit diagram in accordance with an embodiment.

The antenna structure of the various embodiments may be used as a single purpose antenna (i.e., operating across a single frequency band). However, the antenna structure may be designed to operate across multiple networks using multiple desired frequency bands by adding a matching circuit connected to the feed contact 185, 285. An example of such a matching circuit is shown in FIG. 13, which includes a pair of capacitors C1, C2 and an inductor L1 configured as shown between remote elements of the port 1, 2. In this example, port 1 represents the RF circuit side and port 2 represents the bended slot antenna in accordance with aspects disclosed herein.

Figure 14:
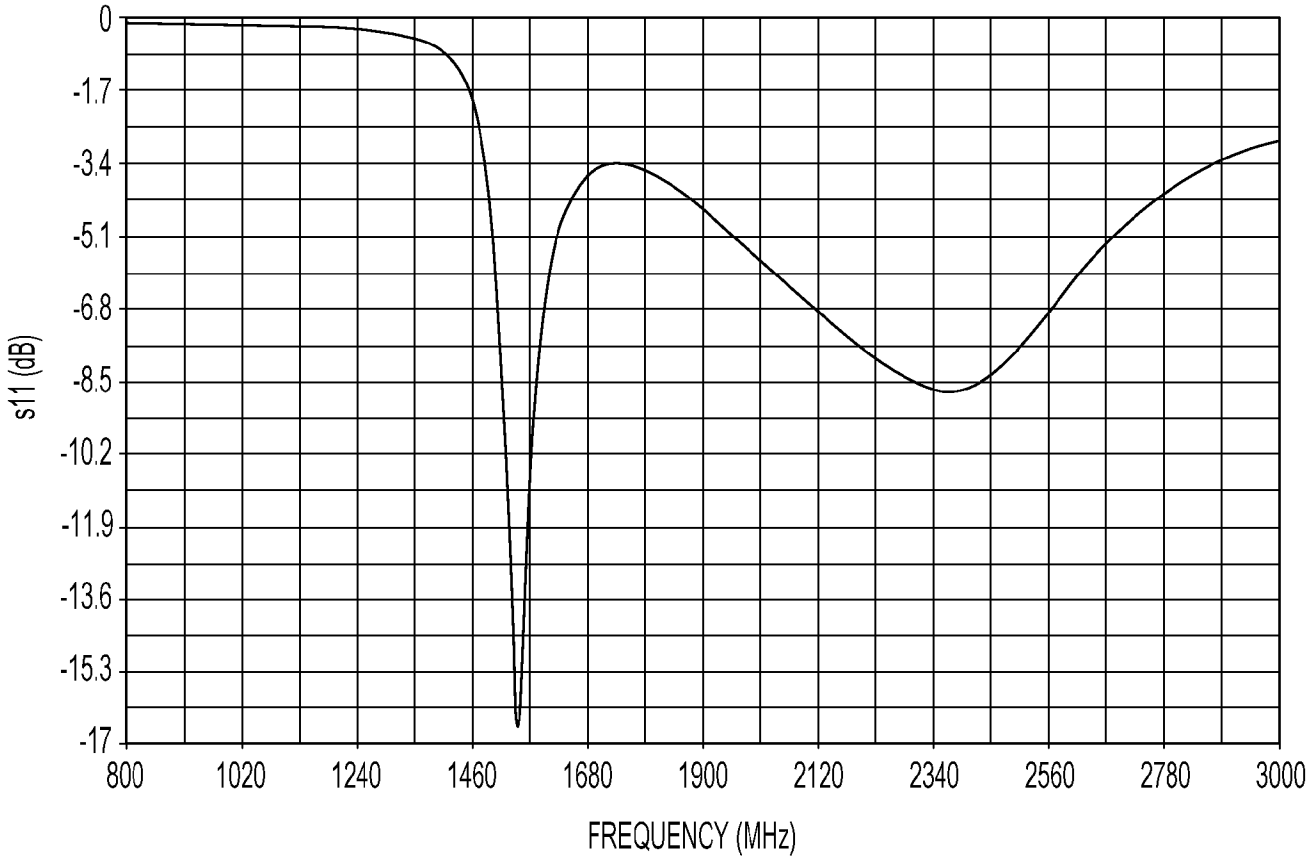
FIG. 14 is a graph of further simulation results of the performance of a multiband slot antenna in accordance an embodiment.
Figure 15:
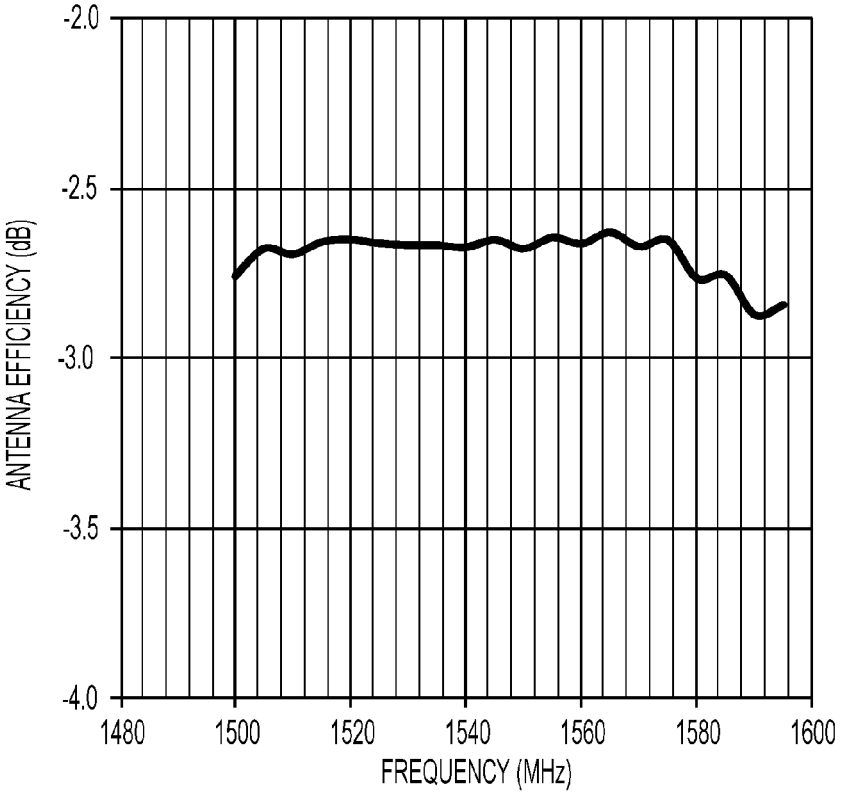
FIG. 15 is a graph the efficiency of a multiband slot antenna operating as a GPS antenna in accordance with an embodiment.
Figure 16:
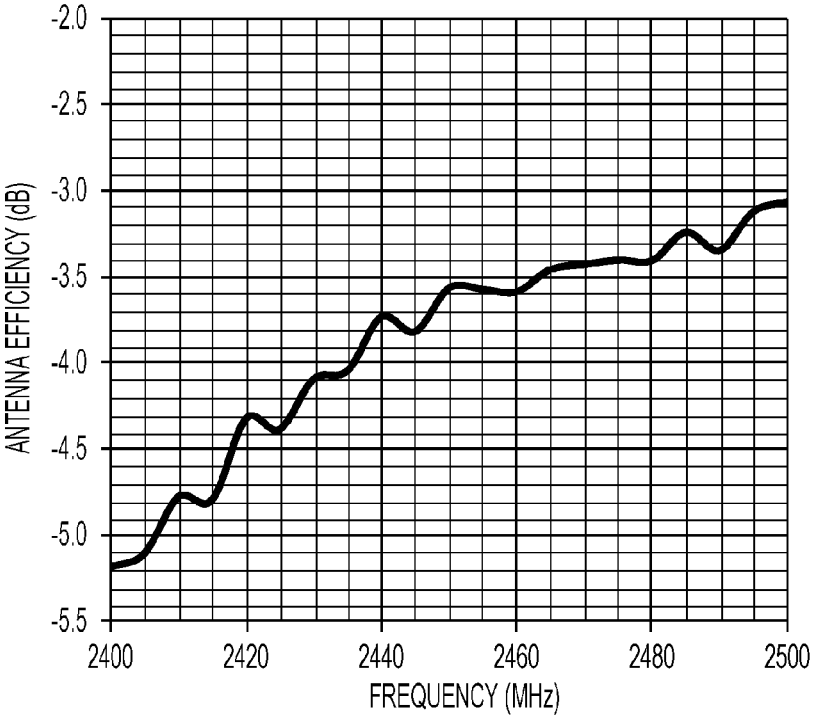
FIG. 16 is a graph of the efficiency of a multiband slot antenna operating as a Bluetooth antenna in accordance with an embodiment.

By applying a matching circuit as noted above, the embodiment multiband antenna structure displays well designed antenna characteristics across both GPS and Bluetooth operating bands. FIG. 14 shows simulated results that illustrate that an embodiment antenna structure may display good operational characteristics (i.e., less than −5 dB measured reflected energy) across both the GPS band (1565-1610 MHz) and Bluetooth band (2400-2500 MHz). FIG. 15 and FIG. 16 show characteristics resulting from a multiband antenna constructed for the dual frequency bands of GPS and Bluetooth in accordance with the embodiments disclosed herein. FIG. 15 illustrates the efficiency between −2.5 dB and −3.0 dB, across a frequency range of between 1500 MHz to almost 1600 MHz. FIG. 16 similarly illustrates the efficiency between −3.0 dB and −5.5 dB, across a frequency range of 2400 MHz to almost 2500 MHz. The efficiency in bluetooth band may be improved by including more antenna matching elements and modifying the length of the slot antenna. In this example embodiment, it is desirable to optimize the antenna performance in GPS band so that the performance in Bluetooth band is compromised to some degree. An example of a configuration, which can achieve such frequency ranges, is shown in FIG. 5. Also, exemplary dimensions for such a multiband antenna may be a housing base portion of 32 mm (where L3=L1) along the y axis and 36 mm L2 along the x axis; a 2 mm offset (L4) is used for the offset 165; the ground contacts 171, 172 each may have a width of 2 mm; the feed contact 185 may have a width of 1.5 mm; the housing antenna portion may be disposed 3 mm above (offset from) the housing base portion; and the ring may have a width of 2 mm.

The various embodiments may include a wrist-worn wireless device that includes radio circuitry, a display coupled to the radio circuitry and a multiband antenna. Similar to that described above, the multiband antenna may include a housing base portion, a housing antenna portion and a feed contact. The housing base portion may be configured to receive the radio circuitry thereon. The housing base portion may include a first peripheral edge and a first conductive material. The housing antenna portion may be spaced away from and substantially opposed to the housing base portion. Also, the housing antenna portion may include a second peripheral edge and a second conductive material. The housing base portion and the housing antenna portion may together form an outermost housing of the wrist-worn wireless device for enclosing a substantial portion of the radio circuitry there between. The first peripheral edge and the second peripheral edge may form opposed lengthwise edges of a slot. Also, the slot may have a width formed by a distance between the first peripheral edge and the second peripheral edge. The feed contact may couple the housing base portion, the housing antenna portion and the radio circuitry for providing a driving frequency to the housing antenna portion from the radio circuitry.

The various embodiments may further include a housing antenna portion that may include an aperture extending from an outwardly facing side of the housing antenna portion to an opposed inwardly facing side of the housing antenna portion. The display may be at least partially disposed in the aperture. The housing antenna portion may include a discontinuity that extends across the housing antenna portion from the second peripheral edge to the aperture. Additionally, at least one ground contact may be coupled to the housing base portion and the housing antenna portion, so that the at least one ground contact together with the housing base portion and the housing antenna portion may form a perimeter of the slot. Alternatively, the at least one ground contact may include at least two ground contacts offset from one another on opposite sides of the slot. A distance between the two ground contacts along an extent on which the feed contact is disposed may substantially equal a whole multiple of half of a wavelength of a signal transmitted and/or received in a first frequency band. The first frequency bandwidth may be, for example, approximately 1565-1606 MHz. Further, the at least one ground contact may include at least three ground contacts offset from one another. The at least one driving frequency may include multiple different driving frequencies separate from one another.

In the various embodiments, the radio circuitry may include a printed circuit board printed directly on the housing base portion. Also, a bezel of the wrist-worn wireless device may be formed by the housing antenna portion. Further, the display may include a liquid crystal display (LCD) operatively coupled to the radio circuitry. The LCD may include a third conductive material on a peripheral portion thereof, such that the third conductive material may be coupled to the second conductive material and may form an extension of the housing antenna portion. Additionally, the first and second conductive materials may be substantially the same material.

Figure 17:
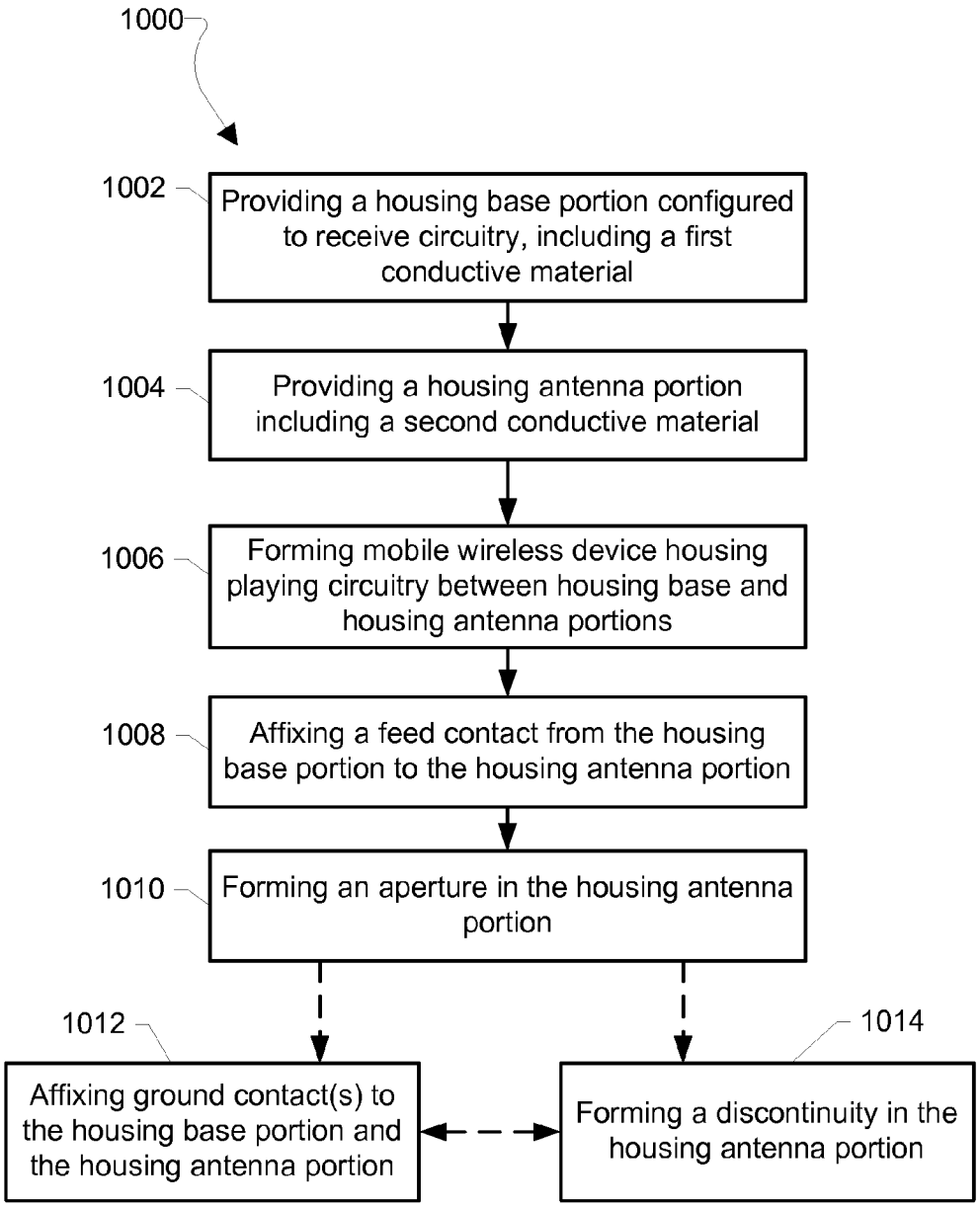
FIG. 17 is a process flow diagram illustrating a method in accordance with the various embodiments.

An embodiment method 1000 for fabricating a multiband antenna is illustrated in FIG. 17. The method includes providing a housing base portion configured to receive circuitry thereon in block 1002. The housing base portion may be configured to extend in a first plane and include a first conductive material. However, the housing base portion need not be a planar element. Also, the housing base portion may be provided with a peripheral edge, which may later form a portion of an antenna slot edge. The method may include in block 1004 providing a housing antenna portion spaced away from and substantially opposed to the housing base portion. The housing antenna portion may also be provided with a peripheral edge, which may also form a portion of the antenna slot edge. Also, the housing antenna portion may include a second conductive material. The second conductive material may be the same as the first conductive material, a different conductive material or a mix thereof.

In block 1006, the method may include forming the housing base portion and the housing antenna portion together into an outermost housing of the mobile wireless device for enclosing a substantial portion of the radio circuitry there between. By forming the outermost housing, the earlier noted peripheral edge of the housing base portion and the peripheral edge of the housing antenna portion may form opposed lengthwise edges of the antenna slot. In this way, the slot may be formed having a width defined by a distance between those peripheral edges. A feed contact may be affixed between the housing base portion and the housing antenna portion, coupling the two portions, in block 1008. Additionally, an aperture may be formed in the housing antenna portion in block 1010. The aperture in the housing antenna portion may be formed to extend through the width of the housing antenna portion from an outwardly facing side of the housing antenna portion to an opposed inwardly facing side of the housing antenna portion. Such an aperture may form the housing antenna portion into a ring (i.e., a closed loop). Additionally, a second or additional aperture(s) may be formed in the housing antenna portion.

Blocks 1012 and 1014 include alternative operations that may be applied to the various embodiments. In block 1012, at least one ground contact may be affixed to the housing base portion and the housing antenna portion. Alternatively no ground contact need be formed, but as a further alternative at least two ground contacts may be formed, wherein the at least two ground contact together with the housing base portion and the housing antenna portion form a perimeter of the antenna slot. As a further alternative, the at least one ground contact may include three or more ground contacts that are affixed to the housing portions, each offset from one another. The feed contact may be disposed between the at least two ground contacts along a periphery of the housing antenna portion. The at least two ground contacts may include two ground contacts offset from one another on opposite sides of the perimeter and disposed on a periphery of the housing base portion. A distance around the periphery may extend away from the slot and substantially equals a whole multiple of one half of a wavelength of a signal transmitted and/or received in a first frequency band. The further alternative of block 1014 includes forming a discontinuity in the housing antenna portion, in which the discontinuity extends across the housing antenna portion from the second peripheral edge to the aperture. Such a discontinuity forms a break in the otherwise continuous loop of the housing antenna portion.

The method 1000 may further include incorporating the multiband antenna into a wrist-worn device including a mobile wireless device. A bezel of the wrist-worn device may be formed by the housing antenna portion. The housing base portion may support at least a portion of circuitry of the wrist-worn device. The method may further include printing a circuit board directly on the housing base portion as part of the radio circuitry. Further, the method may include coupling a liquid crystal display (LCD) to the radio circuitry. The LCD may include a third conductive material on a peripheral portion thereof, and the method may include coupling the third conductive material to the second conductive material, thus forming an extension of the housing antenna portion.

Those of skill in the art will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Any reference to claim elements in the singular, for example, using the articles "a," "an" or "the" is not to be construed as limiting the element to the singular.

One skilled in the relevant art will recognize that many possible modifications and combinations of the aspects of the disclosed embodiments may be used, while still employing the same basic underlying mechanisms and methodologies. The foregoing description, for purposes of explanation, has been written with references to specific embodiments. However, the illustrative discussions above are not intended to be exhaustive or to limit the disclosure to the precise forms disclosed. Many modifications and variations are possible in view of the above teachings. The embodiments were chosen and described to explain the principles of the disclosure and their practical applications, and to enable others skilled in the art to best utilize the disclosure and various embodiments with various modifications as suited to the particular use contemplated. Thus, the present disclosure is not intended to be limited to the embodiments and individual aspects of the disclosed technologies shown and described herein, but is to be accorded the widest scope consistent with the following claims and the principles and novel features disclosed herein.

What is claimed is:

1. A multiband antenna for use in a mobile wireless device, comprising:

a housing base portion configured to receive radio circuitry thereon, the housing base portion including a first peripheral edge and a first conductive material;

a housing antenna portion spaced away from and substantially opposed to the housing base portion, the housing antenna portion including a second peripheral edge and a second conductive material, the housing base portion and the housing antenna portion together forming an outermost housing of the mobile wireless device for enclosing a substantial portion of the radio circuitry there between, the first peripheral edge and the second peripheral edge forming opposed lengthwise edges of a slot, the slot having a width formed by a distance between the first peripheral edge and the second peripheral edge, wherein the housing antenna portion includes a first side facing the housing base portion, an opposed second side, and an aperture extending through the housing antenna portion from the first side to the second side; and a feed contact coupling the housing base portion, the housing antenna portion and the radio circuitry for providing a driving frequency to the housing antenna portion from the radio circuitry.

2. The multiband antenna of claim 1, wherein the housing antenna portion includes a discontinuity, wherein the discontinuity extends across the housing antenna portion from the second peripheral edge to the aperture.

3. The multiband antenna of claim 1, further comprising:

a ground contact coupling the housing base portion and the housing antenna portion, wherein the ground contact together with the housing base portion and the housing antenna portion forming a perimeter of the slot.

4. The multiband antenna of claim 3, wherein the ground contact includes two opposed sides extending from the housing base portion to the housing antenna portion, wherein a distance between the two opposed sides of the ground contact along an extent of at least one of the first peripheral edge and the second peripheral edge substantially equals a whole multiple of half of a wavelength of a signal that is at least one of transmitted and received in a first frequency band.

5. The multiband antenna of claim 3, wherein the ground contact includes two ground contacts offset from one another on opposite sides of the slot.

6. The multiband antenna of claim 5, wherein the housing antenna portion selectively operates at more than one driving frequency.

7. The multiband antenna of claim 5, wherein a distance between the two ground contacts along an extent of at least one of the first peripheral edge and the second peripheral edge on which the feed contact is not disposed substantially equals a whole multiple of half of a wavelength of a signal that is at least one of transmitted and received in a second frequency band.

8. The multiband antenna of claim 5, wherein a distance between the two ground contacts along an extent on which the feed contact is disposed substantially equals a whole multiple of half of a wavelength of a signal that is at least one of transmitted and received in a third frequency band.

9. The multiband antenna of claim 8, wherein the third frequency band is approximately 1565-1606 MHz.

10. The multiband antenna of claim 3, wherein the ground contact includes three ground contacts offset from one another.

11. The multiband antenna of claim 1, wherein the radio circuitry includes a printed circuit board printed directly on the housing base portion.

12. The multiband antenna of claim 11, wherein a bezel of the mobile wireless device is formed by the housing antenna portion.

13. The multiband antenna of claim 1, further comprising:

a liquid crystal display (LCD) operatively coupled to the radio circuitry, the LCD including the second conductive material on a peripheral portion thereof.

14. The multiband antenna of claim 1, wherein the first conductive material and the second conductive material are substantially the same material.

15. A wrist-worn wireless device, comprising:

radio circuitry;

a display coupled to the radio circuitry; and a multiband antenna comprising:

a housing base portion configured to receive the radio circuitry thereon, the housing base portion including a first peripheral edge and a first conductive material;

a housing antenna portion spaced away from and substantially opposed to the housing base portion, the housing antenna portion including a second peripheral edge and a second conductive material, the housing base portion and the housing antenna portion together forming an outermost housing of the wrist-worn wireless device for enclosing a substantial portion of the radio circuitry there between, the first peripheral edge and the second peripheral edge forming opposed lengthwise edges of a slot, the slot having a width formed by a distance between the first peripheral edge and the second peripheral edge, wherein the housing antenna portion includes a first side facing the housing base portion, an opposed second side, and an aperture extending through the housing antenna portion from the first side to the second side; and a feed contact coupling the housing base portion, the housing antenna portion and the radio circuitry for providing a driving frequency to the housing antenna portion from the radio circuitry.

16. The wrist-worn wireless device of claim 15, wherein the housing antenna portion includes a discontinuity, wherein the discontinuity extends across the housing antenna portion from the second peripheral edge to the aperture.

17. The wrist-worn wireless device of claim 15, further comprising:

a ground contact coupling the housing base portion and the housing antenna portion, wherein the ground contact together with the housing base portion and the housing antenna portion forming a perimeter of the slot.

18. The wrist-worn wireless device of claim 17, wherein the ground contact includes two opposed sides extending from the housing base portion to the housing antenna portion, wherein a distance between the two opposed sides of the ground contact along an extent of at least one of the first peripheral edge and the second peripheral edge substantially equals a whole multiple of half of a wavelength of a signal that is at least one of transmitted and received in a first frequency band.

19. The wrist-worn wireless device of claim 17, wherein the ground contact includes two ground contacts offset from one another on opposite sides of the slot.

20. The wrist-worn wireless device of claim 19, wherein the housing antenna portion selectively operates at more than one driving frequency.

21. The multiband antenna of claim 19, wherein a distance between the two ground contacts along an extent of at least one of the first peripheral edge and the second peripheral edge on which the feed contact is not disposed substantially equals a whole multiple of half of a wavelength of a signal that is at least one of transmitted and received in a second frequency band.

22. The multiband antenna of claim 19, wherein a distance between the two ground contacts along an extent on which the feed contact is disposed substantially equals a whole multiple of half of a wavelength of a signal that is at least one of transmitted and received in a third frequency band.

23. The wrist-worn wireless device of claim 22, wherein the third frequency band is approximately 1565-1606 MHz.

24. The wrist-worn wireless device of claim 17, wherein the ground contact includes three ground contacts offset from one another.

25. The wrist-worn wireless device of claim 15, wherein the radio circuitry includes a printed circuit board printed directly on the housing base portion.

26. The wrist-worn wireless device of claim 25, wherein a bezel of the wrist-worn wireless device is formed by the housing antenna portion.

27. The wrist-worn wireless device of claim 15, wherein the display includes a liquid crystal display (LCD) operatively coupled to the radio circuitry, the LCD including the second conductive material on a peripheral portion thereof.

28. The wrist-worn wireless device of claim 15, wherein the first conductive material and the second conductive material are substantially the same material.

29. A multiband antenna for use in a mobile wireless device, comprising:

means for providing a housing base portion configured to receive radio circuitry thereon, the housing base portion including a first peripheral edge and a first conductive material;

means for providing a housing antenna portion spaced away from and substantially opposed to the housing base portion, the housing antenna portion including a second peripheral edge and a second conductive material;

means for forming an outermost housing of the mobile wireless device placing the radio circuitry between the housing base portion and the housing antenna portion, the first peripheral edge and the second peripheral edge forming opposed lengthwise edges of a slot, the slot having a width formed by a distance between the first peripheral edge and the second peripheral edge;

means for forming an aperture in the housing antenna portion, the aperture extending from a first side of the housing antenna portion facing the housing base portion to an opposed second side of the housing antenna portion; and means for affixing a feed contact coupling the housing base portion, the housing antenna portion and the radio circuitry for providing a driving frequency to the housing antenna portion from the radio circuitry.

30. The multiband antenna of claim 29, further comprising:

means for forming a discontinuity in the housing antenna portion, wherein the discontinuity extends across the housing antenna portion from the second peripheral edge to the aperture.

31. The multiband antenna of claim 29, further comprising:

means for further affixing a ground contact to the housing base portion and the housing antenna portion, wherein the ground contact together with the housing base portion and the housing antenna portion forming a perimeter of the slot.

32. The multiband antenna of claim 31, further comprising:

means for driving the housing antenna portion at a first frequency band, wherein the ground contact includes two opposed sides extending from the housing base portion to the housing antenna portion, wherein a distance between the two opposed sides of the ground contact along an extent of at least one of the first peripheral edge and the second peripheral edge substantially equals a whole multiple of half of a wavelength of a signal that is at least one of transmitted and received in the first frequency band.

33. The multiband antenna of claim 31, wherein the ground contact includes two ground contacts offset from one another on opposite sides of the slot.

34. The multiband antenna of claim 33, further comprising:

means for operating the multiband antenna selectively at more than one driving frequency.

35. The multiband antenna of claim 33, wherein a distance between the two ground contacts along an extent of at least one of the first peripheral edge and the second peripheral edge on which the feed contact is not disposed substantially equals a whole multiple of half of a wavelength of a signal that is at least one of transmitted and received in a second frequency band.

36. The multiband antenna of claim 33, wherein a distance between the two ground contacts along an extent on which the feed contact is disposed substantially equals a whole multiple of half of a wavelength of a signal that is at least one of transmitted and received in a third frequency band.

37. The multiband antenna of claim 36, wherein the third frequency band is approximately 1565-1606 MHz.

38. The multiband antenna of claim 31, wherein the ground contact includes three ground contacts offset from one another.

39. The multiband antenna of claim 29, wherein the radio circuitry includes a printed circuit board printed directly on the housing base portion.

40. The multiband antenna of claim 39, wherein a bezel of a wrist-worn wireless device is formed by the housing antenna portion.

41. The multiband antenna of claim 29, further comprising:

means for coupling a liquid crystal display (LCD) to the radio circuitry, the LCD including the second conductive material on a peripheral portion thereof.

42. The multiband antenna of claim 29, wherein the first conductive material and the second conductive material are substantially the same material.

43. A method for making a multiband antenna, comprising:

providing a housing base portion configured to receive radio circuitry thereon, the housing base portion including a first peripheral edge and a first conductive material;

providing a housing antenna portion spaced away from and substantially opposed to the housing base portion, the housing antenna portion including a second peripheral edge and a second conductive material;

forming an outermost housing of a mobile wireless device by placing the radio circuitry between the housing base portion and the housing antenna portion, the first peripheral edge and the second peripheral edge forming opposed lengthwise edges of a slot, the slot having a width formed by a distance between the first peripheral edge and the second peripheral edge;

forming an aperture in the housing antenna portion, the aperture extending from a first side of the housing antenna portion facing the housing base portion to an opposed second side of the housing antenna portion; and affixing a feed contact coupling the housing base portion, the housing antenna portion and the radio circuitry for providing a driving frequency to the housing antenna portion from the radio circuitry.

44. The multiband antenna of claim 43, further comprising:

forming a discontinuity in the housing antenna portion, wherein the discontinuity extends across the housing antenna portion from the second peripheral edge to the aperture.

45. The multiband antenna of claim 43, further comprising:

affixing a ground contact to the housing base portion and the housing antenna portion.

46. The multiband antenna of claim 45, further comprising:

driving the housing antenna portion at a first frequency band, wherein the ground contact includes two opposed sides extending from the housing base portion to the housing antenna portion, wherein a distance between the two opposed sides of the ground contact along an extent of at least one of the first peripheral edge and the second peripheral edge substantially equals a whole multiple of half of a wavelength of a signal that is at least one of transmitted and received in the first frequency band.

47. The multiband antenna of claim 45, wherein the ground contact includes two ground contacts offset from one another on opposite sides of the slot.

48. The multiband antenna of claim 47, further comprising:

operating the multiband antenna selectively at more than one driving frequency.

49. The multiband antenna of claim 47, wherein a distance between the two ground contacts along an extent of at least one of the first peripheral edge and the second peripheral edge on which the feed contact is not disposed substantially equals a whole multiple of half of a wavelength of a signal that is at least one of transmitted and received in a second frequency band.

50. The multiband antenna of claim 47, wherein a distance around at least one of the first peripheral edge and the second peripheral edge between the two ground contacts along an extent on which the feed contact is disposed substantially equals a whole multiple of half of a wavelength of a signal that is at least one of transmitted and received in a third frequency band.

51. The multiband antenna of claim 50, wherein the third frequency band is approximately 1565-1606 MHz.

52. The multiband antenna of claim 45, wherein the ground contact includes three ground contacts offset from one another.

53. The multiband antenna of claim 43, further comprising:

printing a circuit board directly on the housing base portion as part of the radio circuitry.

54. The multiband antenna of claim 53, further comprising:

forming the housing antenna portion into a bezel of the mobile wireless device.

55. The multiband antenna of claim 43, further comprising:

coupling a liquid crystal display (LCD) to the radio circuitry, the LCD including the second conductive material on a peripheral portion thereof.

56. The method of claim 43, wherein the first conductive material and the second conductive material are substantially the same material.

57. The method of claim 43, further comprising:

incorporating the multiband antenna into a wrist-worn wireless device including a mobile communication device.

58. The method of claim 43, further comprising:

forming a second aperture in the housing antenna portion.

* * * * *